United States Patent [19]

Haberle

[11] Patent Number: 4,738,126

[45] Date of Patent: Apr. 19, 1988

[54] RELEASABLE LOCKING DEVICE

[76] Inventor: Bruce V. Haberle, P.O. Box 218, Emmaus, Pa. 18049

[21] Appl. No.: 864,145

[22] Filed: May 16, 1986

[51] Int. Cl.[4] ..... E05B 73/00

[52] U.S. Cl. ..... 70/14; 70/19; 70/237; 70/57; 70/160

[58] Field of Search ..... 70/19, 14, 57, 58, 158–160, 70/163, 166, 167, 237; 280/507; 414/401–403; 292/30, 53, 56, 227; 24/645, 650, 648, 634, 635

[56] References Cited

U.S. PATENT DOCUMENTS

| | | | |
|---|---|---|---|
| 683,286 | 9/1901 | Houser | 70/19 X |
| 710,400 | 10/1902 | Allen | 70/19 |
| 1,549,505 | 8/1925 | Rasmussen | 292/30 X |
| 1,585,962 | 5/1926 | Bray | 70/19 X |
| 1,920,521 | 8/1933 | Patterson | 70/19 |
| 2,248,005 | 7/1941 | Lyman | 24/645 X |
| 2,464,414 | 3/1949 | Pensabene | 24/635 |
| 2,506,943 | 5/1950 | Shreve | 292/30 |
| 2,664,658 | 1/1954 | Bjorklund | 70/58 X |
| 3,237,969 | 3/1966 | Geresy | 280/507 |
| 3,410,580 | 11/1968 | Longenecker | 70/166 X |
| 3,423,968 | 1/1969 | Foote | 70/14 |
| 3,429,151 | 2/1969 | Weingart | 70/14 |
| 3,523,342 | 8/1970 | Spires | 24/634 X |
| 3,585,692 | 6/1971 | Le Mire | 24/635 |
| 3,770,298 | 11/1973 | Phillips | 280/507 X |
| 3,780,546 | 12/1973 | Longenecker | 70/58 |
| 3,914,966 | 10/1975 | Bello | 70/163 |
| 4,226,103 | 10/1980 | Strickland | 70/14 X |
| 4,296,615 | 10/1981 | Zoor | 70/58 X |
| 4,313,321 | 2/1982 | Wasser | 70/159 |
| 4,325,237 | 4/1982 | Menzie | 70/237 X |
| 4,597,354 | 7/1986 | Gelula | 24/645 X |

FOREIGN PATENT DOCUMENTS

| | | | |
|---|---|---|---|
| 1033543 | 7/1958 | Fed. Rep. of Germany | 292/30 |
| 532316 | 8/1955 | Italy | 292/30 |
| 76505 | 2/1933 | Sweden | 292/30 |
| 1287272 | 8/1972 | United Kingdom | 24/650 |

*Primary Examiner*—Robert L. Wolfe
*Assistant Examiner*—Suzanne L. Dino
*Attorney, Agent, or Firm*—Ruth Moyerman

[57] ABSTRACT

A releasable locking device for preventing premature coupling of a truck tractor's air braking glad hand to a truck trailer's air braking glad hand is disclosed. The device includes a set of jaws adapted to interlock with each other and the non air-connecting end of a glad hand. A channel integral with the set of jaws houses a barrel lock to effect control of the interlocking of the set of jaws with the non air-connecting end of the glad hand so that, when the set of jaws is interlocked with each other and the non air-connecting end of a glad hand, an operator may not prematurely couple a truck tractor's air brakes to a truck trailer's air brakes.

8 Claims, 2 Drawing Sheets

10
2
20
140
24
22
30
28
25
138
14
142
144
44
12
146
26
18
16
136

32
36
16
10
12
22
33
48
34
38
18

FIG. 3
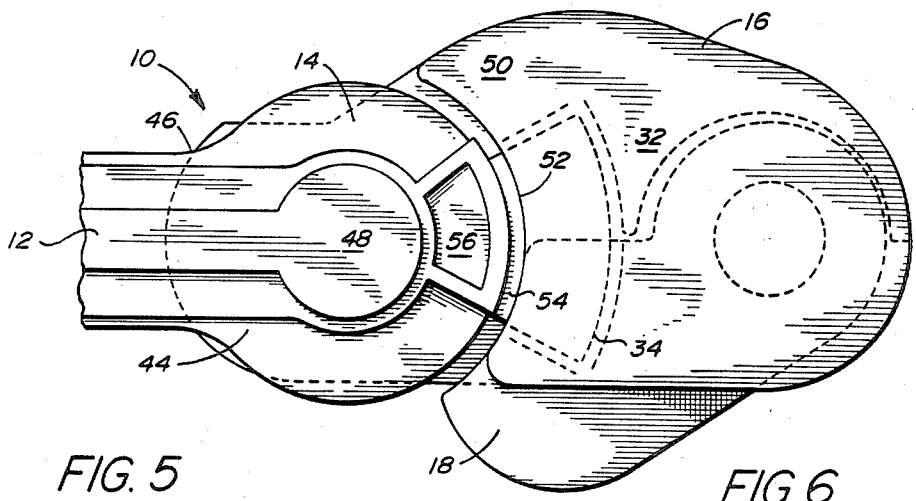
FIG. 5
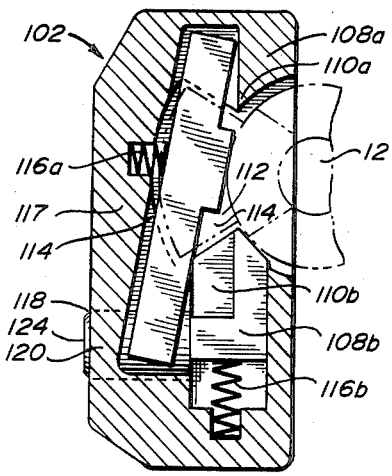
FIG. 6
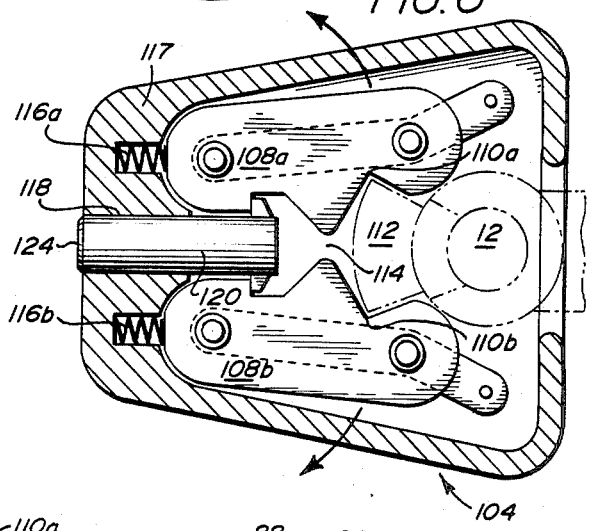
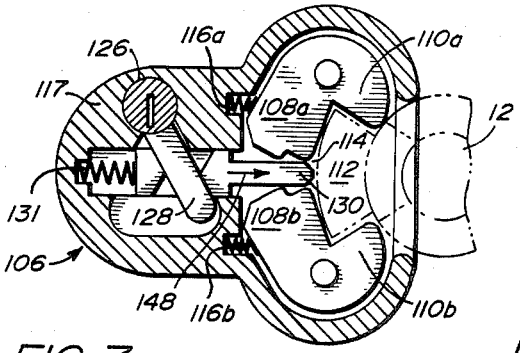
FIG. 7
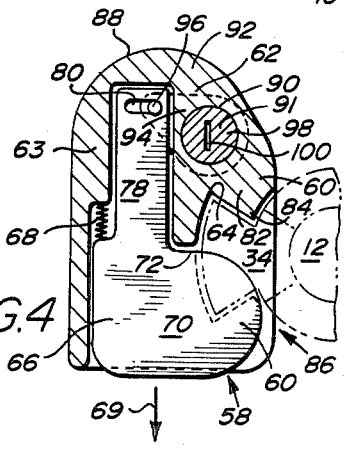
FIG. 4

RELEASABLE LOCKING DEVICE

BACKGROUND OF THE INVENTION

1. Field of the Invention

This invention relates to releasable locking devices and more particularly to a locking device that prevents the premature coupling of a truck tractor's air braking glad hand to a truck trailer's glad hand.

2. Description of the Prior Art

In the trucking industry, safe and efficient loading and unloading of large tractor trailers is a major concern. Accidents and mishaps to both personnel and equipment are likely to occur by reason of the vehicle accidentally, or even deliberately, being removed from the loading area unless there is an effective way to prevent the premature departure of a tractor's trailer from a loading dock or other designated area.

A limited number of devices have been proposed to deal with the problems of premature departure. The majority of these devices, even though they may perform the function, are beset with shortcomings such as (a) the devices are costly, complex, and are highly susceptible to malfunction due to changes in weather conditions or being struck by the vehicle itself, (b) the locking device is awkward and difficult to operate or install, (c) the device is not capable of accommodating all vehicles of various dimensions, configurations and changing heights due to load variances, and (d) the device is dependent on the presence of a loading dock or adjacent structure.

For example, the majority of the devices require a fixedly attached portion to a loading dock or adjacent structure which includes either an adjustable hook to be attached to a trailer in an operative position or released from the trailer in an unoperative position. The following cases are examples of such prior art:

U.S. Pat. No. 4,264,259 to Hipp discloses a device for releasably locking a parked vehicle against a loading dock. The device includes a pivotally mounted member which is movable between operative and inoperative modes. When in an operative mode, the member has a distal portion thereof in interlocking engagement with the parked vehicle. When in an inoperative mode, the distal portion of the member is disposed in a vehicle release position. A power means is provided for actuating the pivotal member between the operative and inoperative modes. A manual control is operatively connected to the power means. A carriage, having a vertically adjustable first section on which the pivotally mounted member is disposed and a second fixedly mounted on the front wall of the loading dock, is provided.

U.S. Pat. No. 4,443,150 to Hahn et al discloses a device for releasably securing a parked vehicle to an adjacent structure. The device includes a carriage having a first section fixedly attached to the adjacent structure, and a second section adjustably mounted on the first section for movement in a substantially vertical direction. Mounted on the carriage second section is a hook-like member which is movable relative thereto between an operative vehicle -- locking mode and an inoperative vehicle-release mode. Mounted on the carriage second section is a composite lock unit having one portion disposed on the carriage second section and an adjustable complemental second portion mounted on the hook-like member. The portions of the lock unit are adapted to co-act with one another and releasably retain the hook-like member in the operative mode.

A manually activated lift unit is mounted on the carriage second section and is selectively movable independently thereof to effect relative movement of the hook-like member from the inoperative mode to the operative mode only when the unit is pulled upwardly a predetermined distance. A manually actuated release mechanism is adjustably mounted on the carriage second section and, when manually activated in one relative direction, engages and moves one lock unit complemental portion so that the latter assumes a non-retaining position with respect to the hook-like member.

The devices of Hipp and Hahn, et al both require the use of a loading dock or adjacent structure. No device is known that does not require the interaction of a loading dock or adjacent structure with a truck's trailer. Likewise, no device is known that discourages the premature departure of a truck trailer by the disconnection or loss of its braking system.

SUMMARY OF THE DISCLOSURE

The aforementioned prior art problems are obviated by the device of this invention in which the preventing of the premature coupling of a truck tractor's air braking glad hand to a truck trailer's air braking glad hand is accomplished, thereby discouraging premature departure of the unit from the loading area.

Both the preferred and alternate embodiments of the device are comprised of a set of jaws adapted to interlock with each other and the non air-connecting end of a glad hand. A lock receiving means integral with the set of jaws receives a locking means to effect control of the interlocking of the set of jaws with the non air-connecting end of a glad hand. When the set of jaws is interlocked with each other and the non air-connecting end of a glad hand, an operator may not prematurely couple a truck tractor's air brakes to a truck trailer's air brakes. The preferred embodiment has an upper shield that fully covers the glad hand's air entry, thereby protecting that area of the glad hand from weather damage. The movable jaw is pivoted through the locking system. The preferred embodiment has a pivoting jaw and the first alternate embodiment has a sliding jaw. The second alternate embodiment has a trigger jaw and a sliding wedge, while the third alternate embodiment has two sliding jaws. The fourth alternate embodiment has two rotating jaws and a spring that depresses a wedge to restrict the movement of the jaws after they have been set by the insertion of the glad hand.

It is, therefore, an object of this invention to provide a device that is not dependent on a loading dock or adjacent structure.

It is a further object of this invention to provide an effective device that discourages the premature departure of a tractor's trailer by the disconnection and subsequent loss of it's braking system.

It is likewise an object of the invention to provide a device that is inexpensive, simple to construct and is protected against malfunction due to weather changes.

It is yet another object of this invention to provide a locking device that is simple to operate and install.

It is still another object of this invention to provide a device that works with the standard air brake glad hand used by all tractor trailer rigs.

It should be appreciated that the device of this invention, like all safety devices, can have its benefits thwarted by a foolish, but determined person. For example, one who is schooled in the art of coupling tractors and their trailers is aware that a tractor may pull a trailer using only the tractor's air braking system. However, this practice is contrary to safe practice, and such use over a period of time (that is, relying solely on the tractor's braking system without the aid of the trailer's braking system) could cause the malfunction or wearing down of the tractor's braking system. Also, the device of this invention does not prevent the coupling of a tractor's fifth wheel to a trailer's king pin. Thus, even with the device of this invention in place, in theory, one could pull away, but it would be perilous as the trailer would be without adequate brakes. With this invention locked to the emergency air brake line of the trailer, the trailer brakes remain engaged during pullout. A tractor has sufficient torque to drag a trailer with emergency brakes engaged, but continued use will result in trailer brake failure.

Also, again for safety reasons, it is recommended that this device be within the control of a loading dock supervisor, and not be trusted to the driver of the tractor.

These and other objects will be more readily ascertainable to one skilled in the art from a consideration of the following FIGURES, description and exemplary embodiments.

BRIEF DESCRIPTION OF THE DRAWING(S)

FIG. 3 is a rear view of the preferred embodiment of this invention including the generally planar upper and lower shields.

FIG. 4 is a cross sectional view of an alternate embodiment of this invention including a glad hand in phantom.

FIG. 5 is a cross sectional view of another alternate embodiment of this invention including a partial of a glad hand in phantom.

FIG. 6 is a cross sectional view of still another alternate embodiment of this invention also including a partial of a glad hand in phantom.

FIG. 7 is a cross sectional view of yet another alternate embodiment of this invention again including a partial of a glad hand in phantom.

DETAILED DESCRIPTION OF THE PREFERRED EMBODIMENT(S)

In reference to language throughout the application, the term "glad hand" is used as a generic term and is understood to mean the coupling, generally cast iron or aluminum, used to innerconnect air braking hoses of a tractor and a trailer. Likewise, the term "barrel" or "cam lock" is intended to refer to stock or shelf items of that description used in many devices and which are well known in the art. The means of coupling a tractor via its "fifth wheel" to a trailer via its "king pin" are also generic terms well known in the art of the trucking industry.

Figure 1:
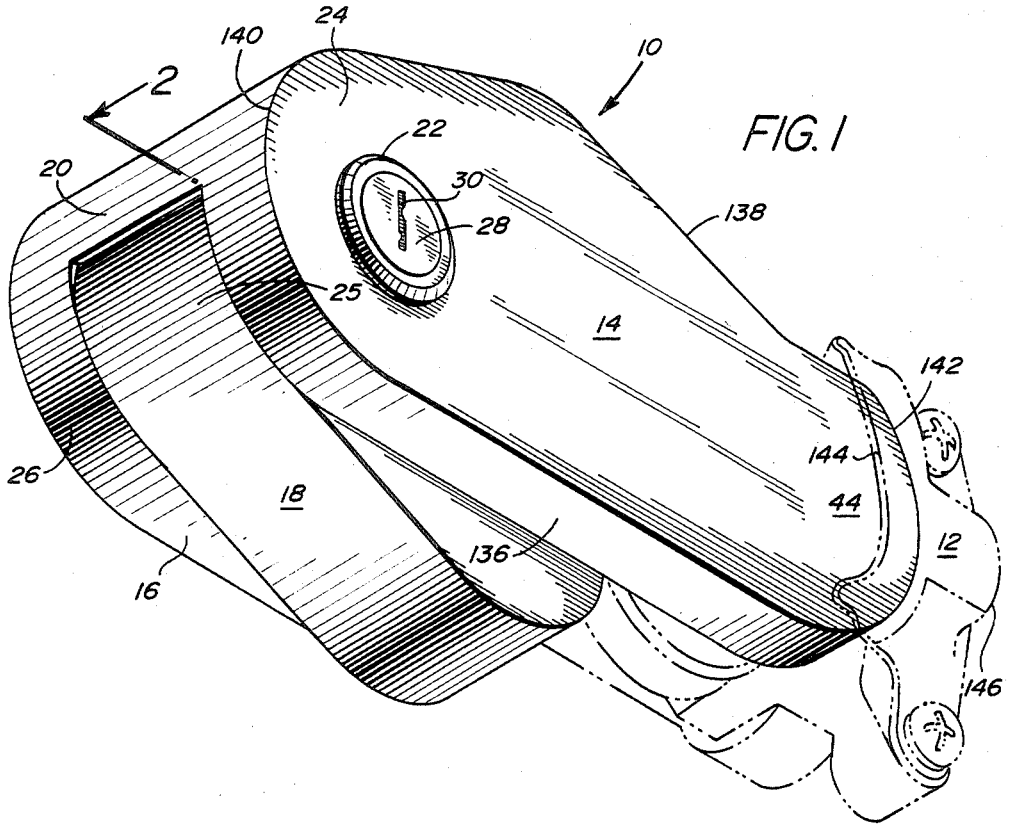
FIG. 1 is an isometric view of the preferred embodiment of this invention including a portion of the glad hand in phantom.

Referring now to the drawings and more particularly to FIG. 1, preferred embodiment locking device 10 is shown in perspective with a portion of the glad hand 12 in phantom. Generally planar upper shield 14 is shown as integral with generally planar lower shield 16 at one of their respective ends 20, thereby providing a housing for pivotal jaw 18.

Transverse channel 22 acts as the lock receiving means through rearward sections 24, 25 and 26, respectively, of upper shield 14, complimentary pivotal jaw 18 and at least a portion of lower shield 16. Barrel lock 28 is seen inserted through transverse channel 22 with key entry 30 exposed through upper shield 14. Upper shield 14 has a configuration which includes generally level bottom 136, convex top 138 and rounded sides 140 and 142. Forward platform 44 fits over the air entry (not shown) of glad hand 12 and terminates under collar 144 (shown in phantom) of air connecting end 146 of glad hand 12 at rounded side 142 of upper shield 14.

In use, the non air-connecting end (not shown) of glad hand 12 has been inserted into the housing to mate with the fixed jaw (not shown) integral to lower shield 16. The housing is formed by the joining at end 20 of integral upper shield 14, the fixed jaw (not shown) and lower shield 16. Pivotal jaw 18, contained by lock 28, has been moved into the housing to interlock with the fixed jaw, thereby forming a collar for the non air-connecting end (not shown) of glad hand 12. Lock 28 has been activated to retain pivotal jaw 18 in a locked position, thereby preventing the premature coupling of trailer glad hand 12 to a tractor's glad hand. While the device of this invention does not totally prevent the premature departure of a truck and its trailer from a loading dock because the tractor trailer could still be coupled through the king pin, it acts as a strong deterrent since use of the device would eventually create a loss of the trailer's braking system.

For safety reasons, the device of this invention should be used, or at least its use controlled by the loading supervisor instead of the driver to insure that the device is, in fact, used.

Figure 2:
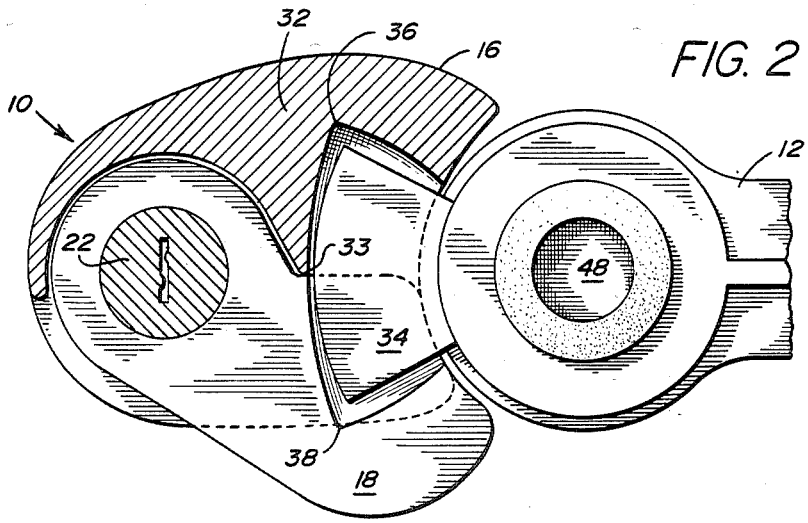
FIG. 2 is a cross sectional view of the preferred embodiment of this invention in the direction of arrow 2 of FIG. 1 showing the jaws interlocked with themselves and the glad hand.

Referring now to FIG. 2, a cross section in the direction of arrow 2 of FIG. 1, locking device 10 more clearly shows fixed jaw 32 and pivotal jaw 18 interlocked with themselves and non air-connecting end 34 of glad hand 12. Fixed jaw 32, integral with lower shield 16, including forward section 36, is seen adapted to surround part of glad hand's end 34. Complimentary pivotal jaw 18 with forward section 38 is adapted to surround the other part of glad hand's end 34, therein mating with fixed jaw 32 to form collar 33.

Channel 22 has been centered through pivotal jaw 18, thereby serving as a pivot point for pivotal jaw 18.

Referring now to FIG. 3, a rear view of preferred embodiment 10 of this invention is shown with upper shield 14 (shown in phantom behind glad hand 12 and covered by lower shield 16) and lower shield 16. Generally planar upper shield 14 includes forward platform section 44 (in phantom) sized and shaped to span and cover at least a portion of top side 46 of glad hand 12. Side 46 is that side which includes air entry portion 48 of glad hand 12. Generally planar lower shield 16, integral with upper shield 14, includes forward section 50 with annular end 52 adapted to abut lower section 54 of glad hand 12's end 34 at its other side 56. Complimentary pivotal jaw 18 (in phantom where it is covered by lower shield 16) has been placed in locking relationship with fixed jaw portion 32 of lower shield 16 and end 34 of glad hand 12.

Referring now to FIG. 4, a cross sectional view of alternate embodiment 58 is shown including glad hand 12 in phantom. Alternate embodiment 58 differs from preferred embodiment 10 in that complimentary jaw 66 slides rather than pivots. Set of jaws 60 includes fixed jaw 62 with forward section 64 adapted to surround part of glad hand 12's non air-connecting end 34. Complimentary jaw 66 is actuated by spring 68 and urged downward in the direction of arrow 69 while in an open position. Forward section 70 of complimentary jaw 66 is adapted to mate with fixed jaw 62 and provide therein collar 72 for glad hand end 34. Rearward section 78 of complimentary jaw 66 includes aperture 80.

Fixed jaw 62 forms a generally planar lower shield 63 and is integral with complimentary jaw 66. Lower fixed jaw 62 includes forward section 82 with annular end 84 adapted to abut under section 86 of glad hand 12's end 34. Fixed jaw 62, with its lower shield, is between and integral to complementary jaw 66 and the upper shield (not shown) at the shield's top 88.

Lock receiving means 90 includes a transverse channel 91 through rearward section 92 of fixed jaw 62 and at least a portion of its integral lower shield 63. Lock receiving means 90 also includes lateral channel 94 workably bisecting transverse channel 91. Lateral channel 94 terminates in connection with aperture 80 which contains pin 96 for cam lock 98 which is workable through key slot 100.

Referring now to FIGS. 5, 6 and 7 and alternate embodiments 102, 104 and 106, respectively, each set of jaws 108 includes a pair of jaws **108*a* and 108*b* with forward sections 110*a* and 110*b* adapted to surround part of end 112 of glad hand 12, thereby forming collar 114. FIG. 7 also includes additional spring 131 which depresses wedge 130 to restrict movement of jaws 108*a* and 108*b* after they have been set by the insertion of glad hand 12. Jaws 108*a* and 108*b* are moved by respective springs 116*a* and 116*b***.

As in the previous embodiments, these alternate embodiments 102, 104 and 106 include a generally planar upper shield (not shown) with forward platforms sized and shaped to span and cover at least a portion of the top side of the glad hand's end. The devices of FIGS. 5, 6 and 7 also include generally planar lower shields 117 integral with the aforementioned upper shields. Likewise, lower shields 117 include forward sections with annular ends adapted to abut the lower sections of glad hand 12's end 112 at its bottom side.

Jaws **108*a* and 108*b* are between and integral to the aforementioned upper shield (not shown) and lower shield 117**.

Referring now to FIGS. 5 and 6, lock receiving means 118 houses lock 120. Key entry through slot 124 moves each of workably connected jaws **108*a* or 108*b*. Jaws 108*a* and 108*b*** are slidable.

Referring now to FIG. 7, lock receiving means 126 includes cam lock 128 workably connected to spring actuated wedge 130. In this view, spring 131 is shown relaxed and has urged wedge 130 in the direction of arrow 148 to lock forward sections **110*a* and 110*b* around end 112 of glad hand 12**.

There are many variations which may be practiced within the scope of this invention. For instance, while upper and lower shields are illustrated and highly recommended for protecting the jaws from weather, they may be omitted and still be within the scope of the invention.

While barrel and cam locks are illustrated and recommended for their function, other locking means may be substituted as long as the lock effects the needed movement of the jaws.

While the jaws and shields are illustrated as integral, this is merely a recommended suggestion and is not necessary to the scope of this invention.

While a barrel lock has been illustrated in the preferred embodiment, the device could be adjusted to receive a cam lock and still be within the scope of this invention.

While it has not been illustrated or specified as to which air braking glad hand the device is attached to, the preferred method would be to attach the device to the emergency air braking glad hand, although the device could be attached to either the emergency or the service system, or both systems, and still be within the scope of this invention.

The device of this invention has many advantages. Chiefly among these is that the device is not dependent on a loading dock or adjacent structure and can be hand carried by the user.

The device is inexpensive, simple and is protected from malfunction due to weather changes.

The device may be operated with one hand and can be used while a tractor is coupled to a trailer.

Having now illustrated and described my invention, it is not intended that such descrition limit the invention, but that the invention be limited only by a reasonable interpretation of the appended claims.

What is claimed is:

1. A portable releasable locking device for preventing the premature coupling of a truck tractor's air braking glad hand to a truck trailer's air braking glad hand, said device comprising:

(a) a set of jaws adapted to interlock with each other and the non air-connecting end of a glad hand, said set of jaws including a fixed jaw with a forward section adapted to surround part of said glad hand's end and a complimentary movable jaw;

(b) a generally planar upper shield on said fixed jaw including a forward platform section sized and shaped to span and cover said glad hand's air entry when said device is engaged and a rearward section which covers generally one face of said pivotable jaw and, (c) means to lock said jaws in fixed relationship one to the other, said shield and said fixed jaw forming a continuous housing for said movable jaw, whereby when said set of jaws is interlocked with each other and said non air-connecting end of said glad hand, an operator may not prematurely couple said truck tractor's air brakes to said truck trailer's air brakes.

2. The device according to claim 1 wherein said device includes, additionally, a generally planar lower shield integral with said upper shield and said fixed jaw, said lower shield including a rearward section which covers generally the opposing face of said jaws so that said shield's rearward sections generally from a housing for said jaws.

3. The device according to claim 2 wherein said fixed jaw is between and integral to said upper shield and said lower shield at one of said shields' respective ends.

4. The device according to claim 1 wherein said lock means includes a transverse channel through said rearward sections, respectively, of said upper shield, said complimentary movable jaw and at least a portion of said lower shield to receive a barrel lock therethrough.

5. A releasable locking device for preventing the premature coupling of a truck tractor's air braking glad hand to a truck trailer's air braking glad hand, said device comprising:

(a) a set of jaws adapted to interlock with each other and the non air-connecting end of a glad hand, said set of jaws including a fixed jaw with a forward section adapted to surround part of said glad hand's end and a complimentary pivotal jaw with a forward section adapted to mate with said fixed jaw and provide therein a collar for said glad hand end;

(b) a pair of shields comprising a generally planar upper shield including a forward platform section sized and shaped to span and cover at least a portion of one side of said glad hand including said glad hand's air entry and a generally planar lower shield integral with said upper shield, said lower shield including a forward section with an annular end adapted to abut the lower section of said glad hand's end at said glad hand's other side, said fixed jaw between and integral with said upper shield and said lower shield at one of said shield's ends, said integral upper shield, said fixed jaw and said lower shield providing a housing for said complimentary pivotal jaw; and, (c) means to lock said jaws in fixed relationship one to the other.

whereby when said set of jaws is interlocked with each other and said non air-connecting end of said glad hand, an operator may not prematurely couple said truck tractor's air brakes to said truck trailer's air brakes.

6. The device according to claim 5 wherein said means to lock includes a transverse channel through the rearward section of said fixed jaw and at least a portion of said lower shield, said means to lock also including a lateral channel workably bissecting said transverse channel at generally said channel's midpoint, said lateral channel terminating at said aperture in said rearward section of said spring-actuated complimentary jaw.

7. The device according to claim 6 wherein said means to lock includes, additionally, a barreled and pinned cam lock, said barrel insertable through said transverse channel with the key entry exposed at said upper shield, said pin insertable through said aperture and said cam connected to said pin and said barrel lock through said lateral channel.

8. The device according to claim 7 wherein said means to lock includes a barrel lock including a cam workably connected to a spring-actuated wedge, said wedge workably connected to said set of jaws.

* * * * *